US009343854B2

(12) United States Patent
Nakamura et al.

(10) Patent No.: US 9,343,854 B2
(45) Date of Patent: May 17, 2016

(54) COAXIAL CONNECTOR PLUG

(71) Applicant: MURATA MANUFACTURING CO., LTD., Nagaokakyo-shi, Kyoto (JP)

(72) Inventors: Shingo Nakamura, Nagaokakyo (JP); Naoaki Fujino, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 22 days.

(21) Appl. No.: 14/447,520

(22) Filed: Jul. 30, 2014

(65) Prior Publication Data

US 2015/0118900 A1 Apr. 30, 2015

(30) Foreign Application Priority Data

Oct. 29, 2013 (JP) ..... 2013-224046

(51) Int. Cl.
*H01R 24/38* (2011.01)
*H01R 12/73* (2011.01)
*H01R 103/00* (2006.01)

(52) U.S. Cl.
CPC ..... *H01R 24/38* (2013.01); *H01R 12/73* (2013.01); *H01R 2103/00* (2013.01)

(58) Field of Classification Search
USPC ..... 439/63, 188, 83, 248; 29/876; 174/262
See application file for complete search history.

(56) References Cited

U.S. PATENT DOCUMENTS

| | | | | |
|---|---|---|---|---|
| 7,008,235 | B2 * | 3/2006 | Watanabe | H01R 24/50 439/581 |
| 2004/0102061 | A1 | 5/2004 | Watanabe | |
| 2013/0143437 | A1 * | 6/2013 | Kenzaki | H01R 9/05 439/578 |
| 2014/0024258 | A1 * | 1/2014 | Tsai | H01R 24/50 439/607.41 |

FOREIGN PATENT DOCUMENTS

| | | | |
|---|---|---|---|
| CN | 202759104 | U | 2/2013 |
| JP | 2004-063372 | A | 2/2004 |
| JP | 2013-118121 | A | 6/2013 |

* cited by examiner

*Primary Examiner* — Alexander Gilman
(74) *Attorney, Agent, or Firm* — Studebaker & Brackett PC

(57) ABSTRACT

A coaxial connector plug includes a first outer conductive unit that includes a first outer conductor that has a substantially ring-like shape in a portion of which a cutting portion is formed when viewed in plan and first and second outer terminals that are drawn out downwardly from the first outer conductor and a first central conductive unit that includes a first central conductor disposed in an area surrounded by the first outer conductor when viewed in plan. The first and second outer terminals are disposed, when viewed in plan from above, further toward the side on which the cutting portion is formed than a second line with the cutting portion interposed between the first and second outer terminals, the second line being perpendicular to a first line, which connects the center of the first outer conductor and the cutting portion, and passing through the center.

7 Claims, 16 Drawing Sheets

COAXIAL CONNECTOR PLUG

CROSS REFERENCE TO RELATED APPLICATIONS

This application claims benefit of priority to Japanese Patent Application No. 2013-224046 filed on Oct. 29, 2013, the entire content of which is incorporated herein by reference.

TECHNICAL FIELD

The present technical field relates to coaxial connector plugs, and more particularly, to a coaxial connector plug that includes an outer conductor that is substantially ring-shaped, a portion of the outer conductor being cut off in such a manner as to form a cutting portion.

BACKGROUND

A coaxial connector plug described in Japanese Unexamined Patent Application Publication No. 2013-118121 is a known example of a coaxial connector plug of the related art. FIG. 16 is an outer perspective view of a coaxial connector plug 510 described in Japanese Unexamined Patent Application Publication No. 2013-118121.

As illustrated in FIG. 16, the coaxial connector plug 510 includes an outer conductive unit 512, a central conductor 514*a*, and an insulator 516. The outer conductive unit 512 includes an outer conductor 512*a* and outer terminals 512*c* and 512*d*. Note that the outer terminal 512*c* is not illustrated in FIG. 16 because the outer terminal 512*c* is covered by the outer conductor 512*a*.

The outer conductor 512*a* has a shape that is substantially cylindrical and that extends in the top-bottom direction. The outer terminals 512*c* and 512*d* are drawn out beneath the outer conductor 512*a*, bent in a direction away from the outer conductor 512*a*, and disposed so as to face each other with the outer conductor 512*a* interposed therebetween as seen from above in plan view.

The insulator 516 has a substantially plate-like shape that has a pair of sides that oppose each other. A lower end of the outer conductor 512*a* is in contact with a top surface of the insulator 516, and a pair of sides of each of a pair of the outer terminals 512*c* and 512*d* are in contact with a bottom surface of the insulator 516, so that the insulator 516 is sandwiched by the outer conductive unit 512 in the top-bottom direction. The central conductor 514*a* is mounted on the insulator 516 and disposed in an area surrounded by the outer conductor 512*a*.

A coaxial connector receptacle is to be mounted on the coaxial connector plug 510, which has the above-described configuration. More specifically, the coaxial connector receptacle includes an outer conductor that has a substantially cylindrical-like shape and a central conductor that is disposed at the center of the outer conductor. The outer conductor of the coaxial connector receptacle is to be inserted into the outer conductor 512*a* of the coaxial connector plug 510. In this case, the central conductor 514*a* of the coaxial connector plug 510 and the central conductor of the coaxial connector receptacle are connected to each other. In addition, elastic deformation occurs in the outer conductor 512*a* in such a manner that a cutting portion that has been formed in the outer conductor 512*a* is slightly widened, and the outer conductor 512*a* is pressed into contact with the outer peripheral surface of the outer conductor of the coaxial connector receptacle. As a result, the coaxial connector plug 510 and the coaxial connector receptacle are fixed to each other.

There has been a demand for a reduction in the height of the coaxial connector plug 510. Therefore, the height of the outer conductor 512*a* has been decreasing year-by-year. However, as the height of the outer conductor 512*a* in the top-bottom direction decreases, the rigidity of the outer conductor 512*a* decreases. Accordingly, the outer conductor 512*a* cannot be pressed into contact with the outer peripheral surface of the outer conductor of the coaxial connector receptacle with sufficient strength. As a result, the coaxial connector plug 510 easily separates from the coaxial connector receptacle.

SUMMARY

Accordingly, it is an object of the present disclosure to provide a coaxial connector plug that can reduce the probability of being easily separated from a coaxial connector receptacle.

According to a preferred embodiment of the present disclosure, there is provided a coaxial connector plug including a first outer conductive unit that includes a first outer conductor that has a substantially ring-like shape in a portion of which a cutting portion is formed when viewed in plan from above and a first outer terminal and a second outer terminal that are drawn out downwardly from the first outer conductor and a first central conductive unit that includes a first central conductor that is disposed in an area surrounded by the first outer conductor when viewed in plan from above. The first outer terminal and the second outer terminal are disposed, when viewed in plan from above, further toward a side on which the cutting portion is formed than a second line with the cutting portion interposed between the first outer terminal and the second outer terminal, the second line being perpendicular to a first line, which connects the center of the first outer conductor and the cutting portion, and passing through the center.

According to a preferred embodiment of the present disclosure, the probability of a coaxial connector plug easily separating from a coaxial connector receptacle can be reduced.

Other features, elements, characteristics and advantages of the present disclosure will become more apparent from the following detailed description of preferred embodiments of the present disclosure with reference to the attached drawings.

DETAILED DESCRIPTION

A coaxial connector plug according to an embodiment of the present disclosure will be described below.

Configuration of Coaxial Connector Plug

Figure 1:
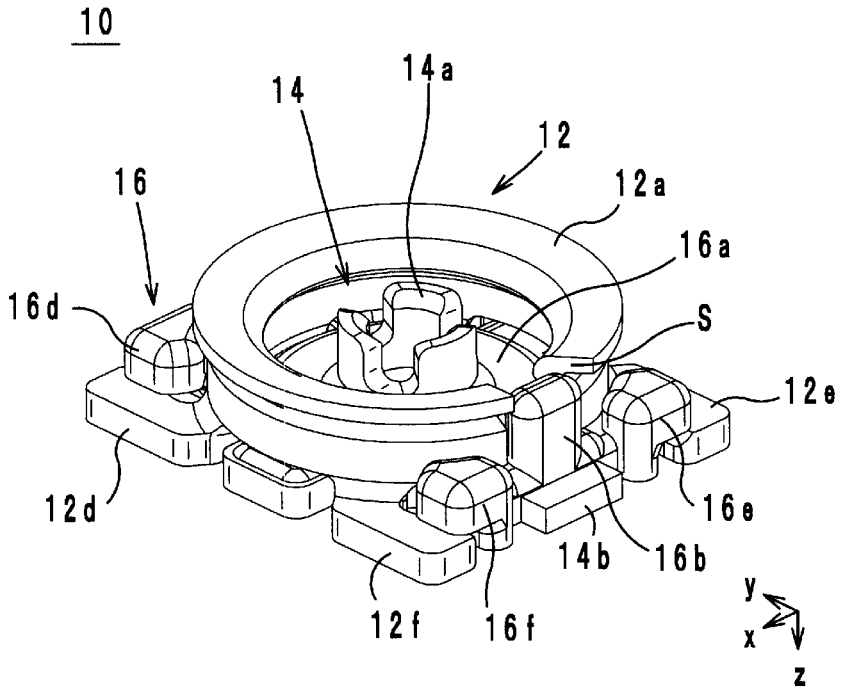
FIG. 1 is an outer perspective view of a coaxial connector plug 10 according to an embodiment of the present disclosure.
Figure 2:
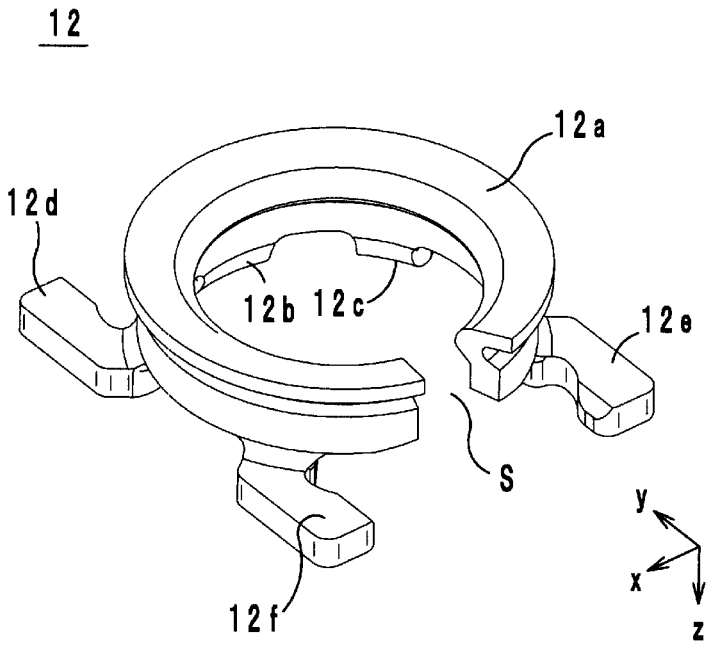
FIG. 2 is an external perspective view of an outer conductive unit 12 of the coaxial connector plug 10.
Figure 3:
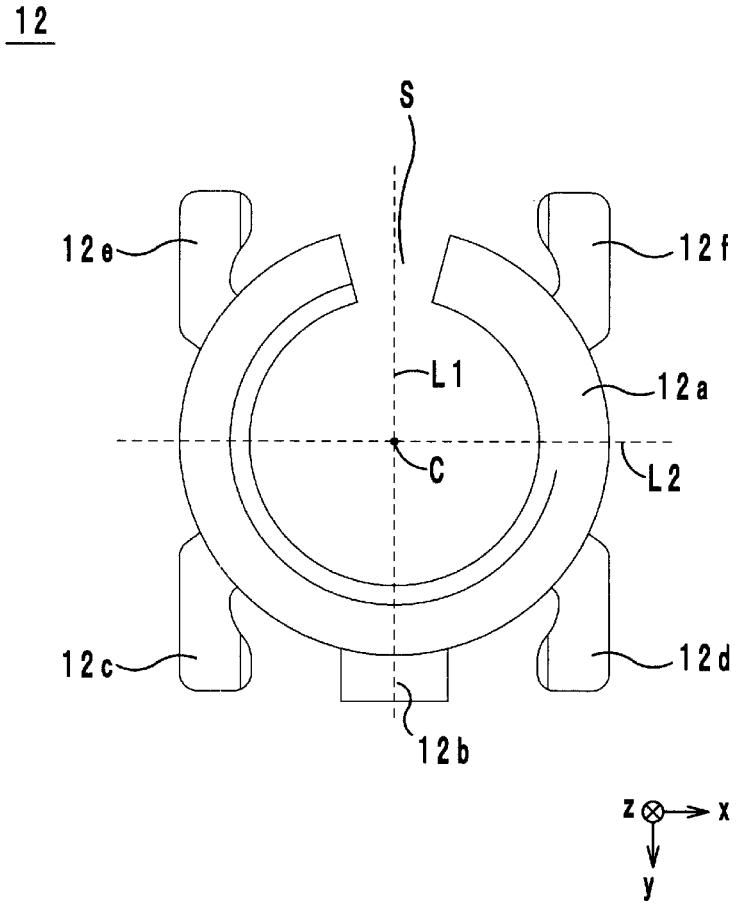
FIG. 3 is a diagram illustrating the outer conductive unit 12 when viewed in plan in the z-axis direction.
Figure 4:
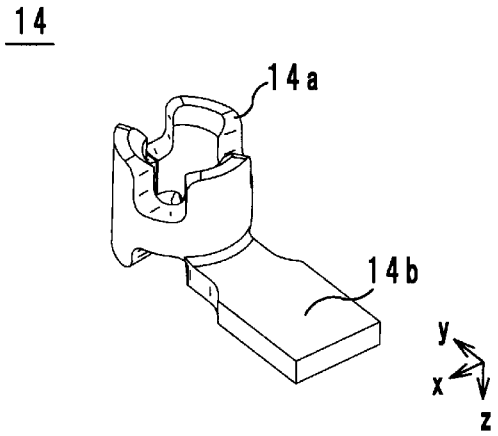
FIG. 4 is an external perspective view of a central conductive unit 14 of the coaxial connector plug 10.
Figure 5:
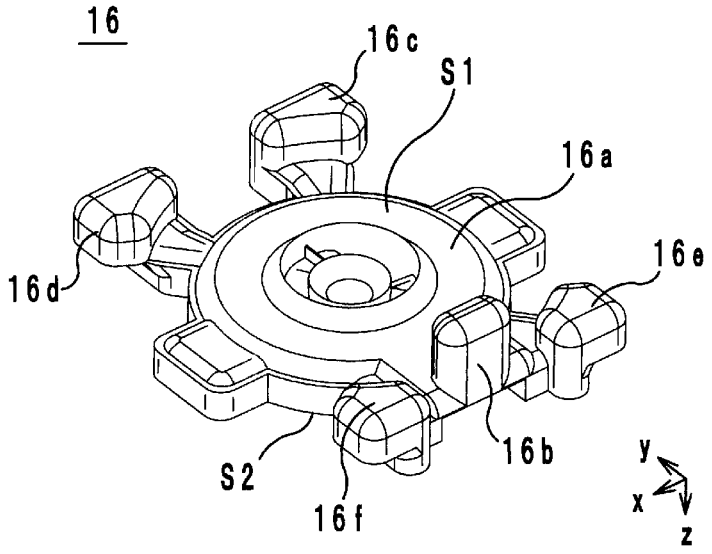
FIG. 5 is an external perspective view of an insulator 16 of the coaxial connector plug 10.

First, the coaxial connector plug according to the embodiment of the present disclosure will be described with reference to FIG. 1 to FIG. 5. FIG. 1 is an outer perspective view of a coaxial connector plug 10 according to the embodiment of the present disclosure. FIG. 2 is an external perspective view of an outer conductive unit 12 of the coaxial connector plug 10. FIG. 3 is a diagram illustrating the outer conductive unit 12 when viewed in plan in the z-axis direction. FIG. 4 is an external perspective view of a central conductive unit 14 of the coaxial connector plug 10. FIG. 5 is an external perspective view of an insulator 16 of the coaxial connector plug 10.

A coaxial connector receptacle, which will be described later, is to be mounted on the coaxial connector plug 10 from below. In other words, when the coaxial connector plug 10 is used, the coaxial connector plug 10 is used in a state where an opening thereof faces downward. Note that, for convenience of description, the upward direction in FIG. 1 is a direction towards the upper side in the vertical direction, and the downward direction in FIG. 1 is a direction towards the lower side in the vertical direction. In addition, the downward direction in FIG. 1 is defined as the positive side in the z-axis direction, and the upward direction in FIG. 1 is defined as the negative side in the z-axis direction.

The coaxial connector plug 10 has a substantially rectangular shape when viewed in plan in the z-axis direction. A direction in which one of two sides of the coaxial connector plug 10 extends and a direction in which the other one of the two sides of the coaxial connector plug 10 extends when the coaxial connector plug 10 is viewed in plan in the z-axis direction are defined as the x-axis direction and the y-axis direction, respectively. The x-axis direction, the y-axis direction, and the z-axis direction are perpendicular to one another.

The coaxial connector plug 10 is to be mounted on a circuit board such as a flexible printed circuit board, and as illustrated in FIG. 1 and FIG. 2, the coaxial connector plug includes the outer conductive unit 12, the central conductive unit 14, and the insulator 16.

The outer conductive unit 12 is fabricated by performing punching and bending on a single metallic sheet (which is, for example, made of phosphor bronze) that has conductivity and elasticity. In addition, the outer conductive unit 12 is plated with nickel, silver, or gold. As illustrated in FIG. 1 to FIG. 3, the outer conductive unit 12 includes an outer conductor 12*a* and outer terminals 12*b* to 12*f*. As illustrated in FIG. 1 to FIG. 3, the outer conductor 12*a* has a shape that is substantially cylindrical and that extends in the z-axis direction.

In addition, as illustrated in FIG. 1 to FIG. 3, the outer conductor 12*a* has a substantially ring-like shape in a portion of which a cutting portion S is formed when viewed in plan in the z-axis direction. In the outer conductor 12*a*, the cutting portion S extends in the z-axis direction. In addition, the outer conductor 12*a* has a configuration in which the outer conductor 12*a* is open at the cutting portion S and has a so-called substantially C-like shape. In the following description, as illustrated in FIG. 3, the center of the outer conductor 12*a* when the outer conductor 12*a* is viewed in plan in the z-axis direction will be referred to as a center C. A straight line that connects the center C and the cutting portion S will be referred to as a straight line L1. Note that the straight line L1 passes through the center of the cutting portion S. A straight line that passes through the center C and that is perpendicular to the straight line L1 will be referred to as a straight line L2. The straight line L1 is parallel to the y-axis direction, and the straight line L2 is parallel to the x-axis direction.

As illustrated in FIG. 2 and FIG. 3, the outer terminals 12*b* to 12*f* are connected to the outer conductor 12*a*. The outer terminals 12*b* to 12*f* are drawn out from the outer conductor 12*a* toward the positive side in the z-axis direction and extend in a direction away from the outer conductor 12*a* when viewed in plan in the z-axis direction.

The outer terminal 12*b* is drawn out from the outer conductor 12*a* toward the positive side in the z-axis direction and bent toward the positive side in the y-axis direction. More specifically, the outer terminal 12*b* is connected to the outer conductor 12*a* at a position on the positive side in the y-axis direction with respect to the center C when viewed in plan in the z-axis direction and extends in a direction opposite to a direction from center C toward the cutting portion S (i.e., toward the positive side in the y-axis direction).

As illustrated in FIG. 1 to FIG. 3, the outer terminals 12*c* and 12*d* are disposed further toward the side opposite to the side on which the cutting portion S is formed (i.e., the positive side in the y-axis direction) than the straight line L2 when viewed in plan in the z-axis direction. More specifically, as illustrated in FIG. 3, when viewed in plan in the z-axis direction, the outer terminal 12*c* is connected to the outer conductor 12*a* at a position where the cutting portion S would be if the outer conductor 12*a* were to be rotated about 135 degrees about the center C in a counterclockwise direction. In addition, the outer terminal 12*c* is drawn out from the outer conductor 12*a* to the positive side in the z-axis direction. Furthermore, the outer terminal 12*c* extends in a direction from the center C toward a portion in which the outer terminal 12*c* and the outer conductor 12*a* are connected to each other and is bent toward the positive side in the y-axis direction when viewed in plan in the z-axis direction.

On the other hand, as illustrated in FIG. 3, when viewed in plan in the z-axis direction, the outer terminal 12*d* is connected to the outer conductor 12*a* at a position where the cutting portion S would be if the outer conductor 12*a* were to be rotated about 135 degrees about the center C in a clockwise direction. The outer terminal 12*d* is drawn out from the outer conductor 12*a* to the positive side in the z-axis direction. In addition, the outer terminal 12*d* extends in a direction from the center C toward a portion in which the outer terminal 12*d* and the outer conductor 12*a* are connected to each other and is bent toward the positive side in the y-axis direction when viewed in plan in the z-axis direction.

As illustrated in FIG. 1 to FIG. 3, the outer terminals 12*e* and 12*f* are disposed further toward the side on which the cutting portion S is formed (i.e., the negative side in the y-axis direction) than the straight line L2 with the cutting portion S interposed therebetween when viewed in plan in the z-axis direction. More specifically, as illustrated in FIG. 3, when viewed in plan in the z-axis direction, the outer terminal 12*e* is connected to the outer conductor 12*a* at a position where the cutting portion S would be if the outer conductor 12*a* were to be rotated about 45 degrees about the center C in a counter-clockwise direction. In addition, the outer terminal 12*e* is drawn out from the outer conductor 12*a* to the positive side in the z-axis direction. Furthermore, the outer terminal 12*e* extends in a direction from the center C toward a portion in which the outer terminal 12*e* and the outer conductor 12*a* are connected to each other and is bent toward the negative side in the y-axis direction when viewed in plan in the z-axis direction.

On the other hand, as illustrated in FIG. 3, when viewed in plan in the z-axis direction, the outer terminal 12*f* is connected to the outer conductor 12*a* at a position where the cutting portion S would be if the outer conductor 12*a* were to be rotated about 45 degrees about the center C in a clockwise direction. The outer terminal 12*f* is drawn out from the outer conductor 12*a* to the positive side in the z-axis direction. In addition, the outer terminal 12*f* extends in a direction from the center C toward a portion in which the outer terminal 12*f* and the outer conductor 12*a* are connected to each other and is bent toward the negative side in the y-axis direction when viewed in plan in the z-axis direction.

As illustrated in FIG. 3, when viewed in plan in a direction in which the straight line L1 extends (i.e., the y-axis direction), the outer terminals 12*c* to 12*f*, which have the above-described configurations, do not project out from the outer conductor 12*a* in a direction in which the straight line L2 extends (i.e., the x-axis direction).

The central conductive unit 14 is fabricated by performing punching and bending on a single metallic sheet (which is, for example, made of phosphor bronze). In addition, the central conductive unit 14 is plated with nickel, silver, or gold. As illustrated in FIG. 1 and FIG. 4, the central conductive unit 14 includes a central conductor 14*a* and an outer terminal 14*b*.

As illustrated in FIG. 1, the central conductor 14*a* is disposed in an area surrounded by the outer conductor 12*a* (more specifically, at the position of the center C of the outer conductor 12*a*) when viewed in plan in the z-axis direction. In addition, as illustrated in FIG. 4, the central conductor 14*a* has a shape that is substantially cylindrical and that extends in the z-axis direction. Three cutting portions that extend in the top-bottom direction are formed in the central conductor 14*a*. With this configuration, the central conductor 14*a* can be slightly widened in the horizontal direction. As illustrated in FIG. 4, the outer terminal 14*b* is connected to an end portion of the central conductor 14*a* on the positive side in the z-axis direction and linearly extends toward the negative side in the y-axis direction.

The insulator 16 is made of an insulating material such as a resin, and as illustrated in FIG. 5, the insulator 16 includes a base portion 16*a*, a projection 16*b*, and engagement portions 16*c* to 16*f*. As illustrated in FIG. 5, the base portion 16*a* is a plate member having a substantially circular shape when viewed in plan in the z-axis direction. Note that a major surface of the base portion 16*a* on the negative side in the z-axis direction will be referred to as a top surface S1, and a major surface of the base portion 16*a* on the positive side in the z-axis direction will be referred to as a bottom surface S2.

The projection 16*b* is disposed on the negative side in the y-axis direction with respect to the base portion 16*a* and projects toward the negative side in the z-axis direction with respect to the base portion 16*a*.

The engagement portions 16*c* to 16*f* radially project from the base portion 16*a* when viewed in plan in the z-axis direction. More specifically, the engagement portion 16*c* extends from the base portion 16*a* toward the positive side in the y-axis direction and the negative side in the x-axis direction. The engagement portion 16*d* extends from the base portion 16*a* toward the positive side in the y-axis direction and the positive side in the x-axis direction. The engagement portion 16*e* extends from the base portion 16*a* toward the negative side in the y-axis direction and the negative side in the x-axis direction. The engagement portion 16*f* extends from the base portion 16*a* toward the negative side in the y-axis direction and the positive side in the x-axis direction.

The central conductive unit 14 is mounted on the insulator 16. More specifically, as illustrated in FIG. 1, the central conductive unit 14 and the insulator 16 are integrally molded by insert molding. Thus, the central conductor 14*a* projects toward the negative side in the z-axis direction at the center of the base portion 16*a*. In addition, the outer terminal 14*b* of the central conductive unit 14 is drawn out from the insulator 16 toward the negative side in the y-axis direction at a portion of the projection 16*b* on the positive side in the z-axis direction.

The outer conductive unit 12 is mounted on the insulator 16. More specifically, as illustrated in FIG. 1, an end portion of the outer conductor 12*a* on the positive side in the z-axis direction is in contact with the top surface S1 of the base portion 16*a*. The outer terminals 12*c* to 12*f* engage with the engagement portions 16*c* to 16*f*, respectively. More specifically, the outer terminal 12*c* is drawn out from the negative side in the x-axis direction with respect to the engagement portion 16*c* toward the positive side in the z-axis direction with respect to the engagement portion 16*c*. The outer terminal 12*d* is drawn out from the positive side in the x-axis direction with respect to the engagement portion 16*d* toward the positive side in the z-axis direction with respect to the engagement portion 16*d*. The outer terminal 12*e* is drawn out from the negative side in the x-axis direction with respect to the engagement portion 16*e* toward the positive side in the z-axis direction with respect to the engagement portion 16*e*. The outer terminal 12*f* is drawn out from the positive side in the x-axis direction with respect to the engagement portion 16*f* toward the positive side in the z-axis direction with respect to the engagement portion 16*f*. The outer terminal 12*b* is drawn out toward the positive side in the z-axis direction with respect to the insulator 16 between the engagement portion 16*c* and the engagement portion 16*d*. With this configuration, the insulator 16 is mounted on the outer conductor 12*a* on the positive side in the z-axis direction.

As illustrated in FIG. 1, the projection 16*b* is positioned within the cutting portion S. In other words, the projection 16*b* functions as a cover member that fills the cutting portion S. However, the projection 16*b* is not in contact with the outer conductor 12*a*. In other words, there is a small gap between the projection 16*b* and the outer conductor 12*a*. This enables the outer conductor 12*a* to become slightly deformed in a direction in which the diameter thereof decreases.

Coaxial Connector Receptacle

Figure 6:
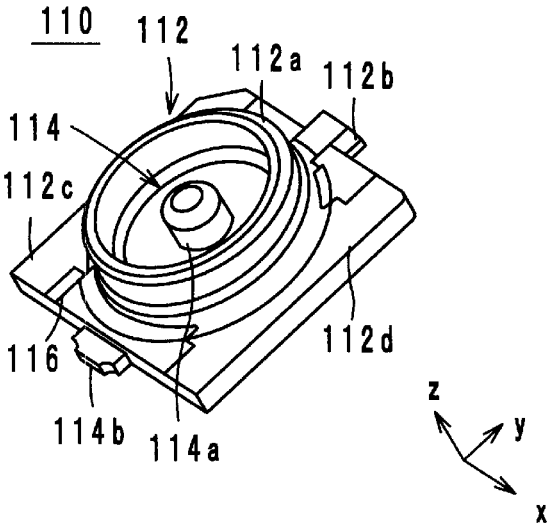
FIG. 6 is an external perspective view of a coaxial connector receptacle 110 according to the embodiment of the present disclosure.
Figure 7:
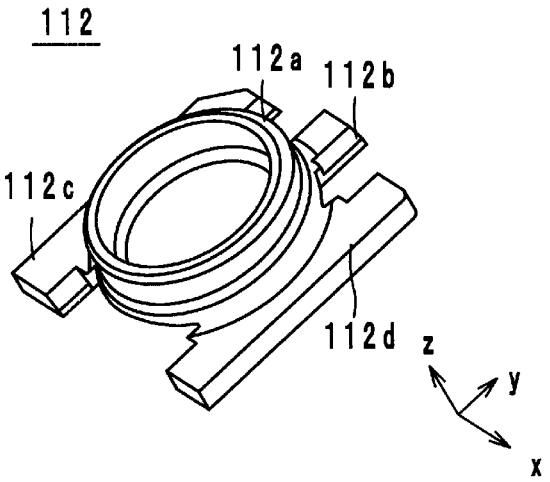
FIG. 7 is an external perspective view of an outer conductive unit 112 of the coaxial connector receptacle 110.
Figure 8:
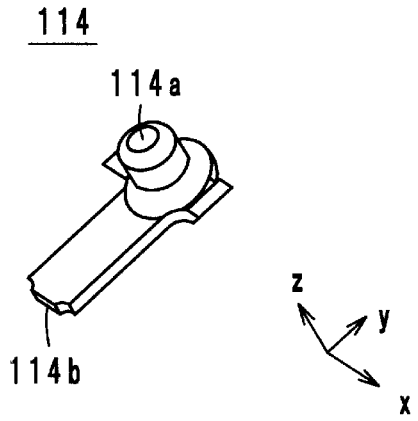
FIG. 8 is an external perspective view of a central conductive unit 114 of the coaxial connector receptacle 110.
Figure 9:
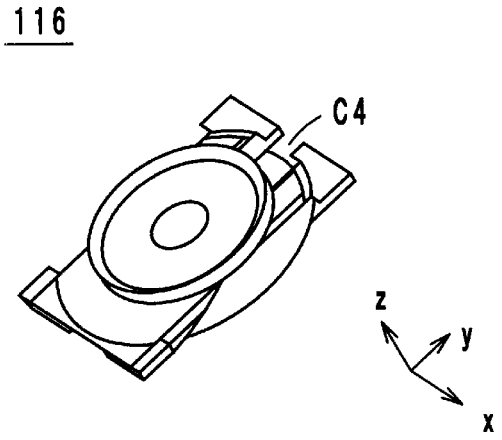
FIG. 9 is an external perspective view of an insulator 116 of the coaxial connector receptacle 110.

A coaxial connector receptacle that is to be mounted on the coaxial connector plug 10 according to the embodiment of the present disclosure will now be described with reference to FIG. 6 to FIG. 9. FIG. 6 is an external perspective view of a coaxial connector receptacle 110 according to the embodiment of the present disclosure. FIG. 7 is an external perspective view of an outer conductive unit 112 of the coaxial connector receptacle 110. FIG. 8 is an external perspective view of a central conductive unit 114 of the coaxial connector receptacle 110. FIG. 9 is an external perspective view of an insulator 116 of the coaxial connector receptacle 110.

In the following description, a direction normal to a surface of the insulator 116 in FIG. 6 is defined as the z-axis direction, and when viewed in plan in the z-axis direction, a direction that is parallel to one of two sides of the insulator 116 and a direction that is parallel to the other one of the two sides of the insulator 116 are defined as the x-axis direction and the y-axis direction, respectively. The x-axis direction, the y-axis direction, and the z-axis direction are perpendicular to one another. In addition, the z-axis direction is the vertical direction.

However, the coaxial connector receptacle 110 is to be mounted on the coaxial connector plug 10 from below. In other words, when the coaxial connector receptacle 110 is used, the coaxial connector receptacle 110 is used in a state where an opening thereof faces upward. Thus, the upward direction in FIG. 6 is a direction towards the upper side in the vertical direction, and the downward direction in FIG. 6 is a direction towards the lower side in the vertical direction. Accordingly, the upward direction in FIG. 6 is defined as the positive side in the z-axis direction, and the downward direction in FIG. 6 is defined as the negative side in the z-axis direction.

The coaxial connector receptacle 110 is to be mounted on a circuit board such as a flexible printed circuit board, and as illustrated in FIG. 6, the coaxial connector receptacle 110 includes the outer conductive unit 112, the central conductive unit 114, and the insulator 116.

The outer conductive unit 112 is fabricated by performing punching and bending on a single metallic sheet (which is, for example, made of phosphor bronze) that has conductivity and elasticity. In addition, the outer conductive unit 112 is plated with nickel, silver, or gold. As illustrated in FIG. 6 and FIG. 7, the outer conductive unit 112 includes an outer conductor 112*a* and outer terminals 112*b* to 112*d*. As illustrated in FIG. 6 and FIG. 7, the outer conductor 112*a* has a shape that is substantially cylindrical and that extends in the z-axis direction.

The outer terminals 112*b* to 112*d* are connected to the outer conductor 112*a* and disposed on the negative side in the z-axis direction with respect to the outer conductor 112*a*. The outer terminal 112*b* is drawn out from the outer conductor 112*a* toward the negative side in the z-axis direction and bent toward the positive side in the y-axis direction. The outer terminal 112*c* is drawn out from the outer conductor 112*a* toward the negative side in the z-axis direction and bent toward the negative side in the x-axis direction. In addition, the outer terminal 112*c* has a substantially T-like shape when viewed in plan in the z-axis direction. The outer terminal 112*d* is drawn out from the outer conductor 112*a* toward the negative side in the z-axis direction and bent toward the positive side in the x-axis direction. In addition, the outer terminal 112*d* has a substantially T-like shape when viewed in plan in the z-axis direction.

The central conductive unit 114 is fabricated by performing punching and bending on a single metallic sheet (which is, for example, made of phosphor bronze). In addition, the central conductive unit 114 is plated with nickel, silver, or gold. As illustrated in FIG. 6 and FIG. 8, the central conductive unit 114 includes a central conductor 114*a* and an outer terminal 114*b*.

As illustrated in FIG. 6, the central conductor 114*a* is disposed at the center of the outer conductor 112*a* in such a manner as to extend in the z-axis direction. In other words, the central conductor 114*a* is surrounded by the outer conductor 112*a* when viewed in plan in the z-axis direction. As illustrated in FIG. 8, the central conductor 114*a* has a substantially columnar shape that extends in the z-axis direction.

As illustrated in FIG. 6, the outer terminal 114*b* is connected to an end portion of the central conductor 114*a* on the negative side in the z-axis direction and extends toward the negative side in the y-axis direction. As illustrated in FIG. 6, the outer terminal 114*b* faces the outer conductor 112*b* with the center of the outer conductor 112*a* interposed therebetween when viewed in plan in the z-axis direction.

The insulator 116 is made of an insulating material such as a resin, and as illustrated in FIG. 6 and FIG. 9, the insulator 116 has a substantially rectangular shape when viewed in plan in the z-axis direction. However, a cutout portion C4 is formed in the insulator 116. The cutout portion C4 is formed by removing a center portion of a side of the insulator 116 on the positive side in the y-axis direction.

The outer conductive unit 112, the central conductive unit 114, and the insulator 116 are integrally molded by insert molding. With this configuration, the outer conductor 112*a* projects toward the positive side in the z-axis direction at the center of the insulator 116. An end portion of the outer conductor 112*a* on the negative side in the z-axis direction is covered with the insulator 116. The outer terminal 112*b* is drawn out outside the insulator 116 through the cutout portion C4. In addition, the outer terminals 112*c* and 112*d* are drawn out outside the insulator 116 from a side of the insulator 116 on the negative side in the x-axis direction and a side of the insulator 116 on the positive side in the x-axis direction, respectively. The central conductor 114*a* projects from the insulator 116 toward the positive side in the z-axis direction in an area surrounded by the outer conductor 112*a*. The outer terminal 114*b* is drawn out from the insulator 116 toward the negative side in the y-axis direction.

Mounting of Coaxial Connector Receptacle onto Coaxial Connector Plug

Figure 10:
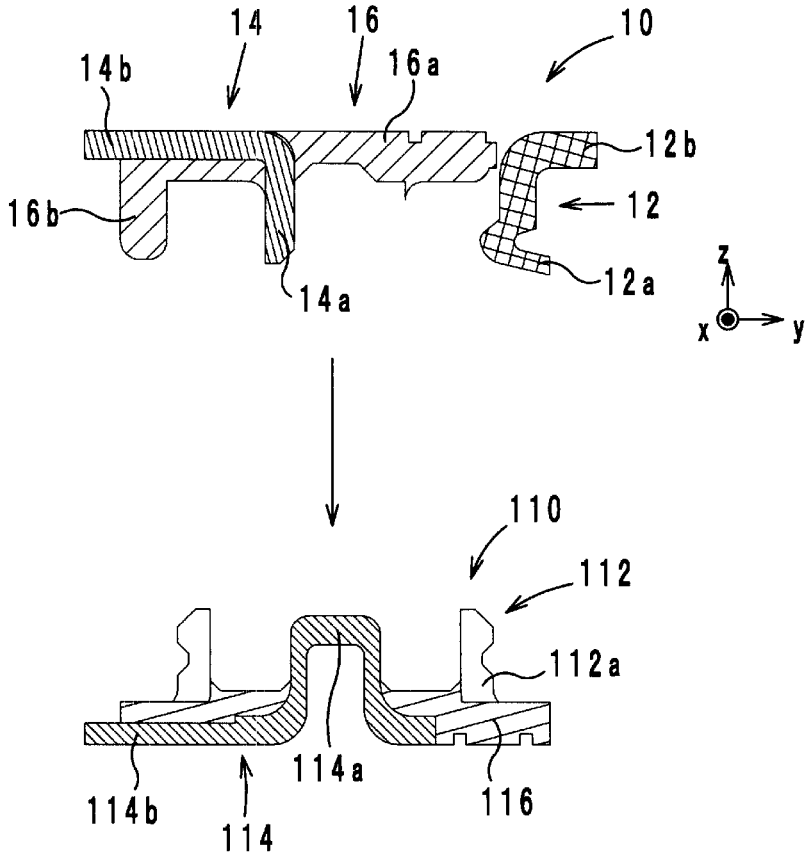
FIG. 10 is a diagram illustrating the sectional structures of the coaxial connector plug 10 and the coaxial connector receptacle 110 before the coaxial connector receptacle 110 is mounted on the coaxial connector plug 10.
Figure 11:
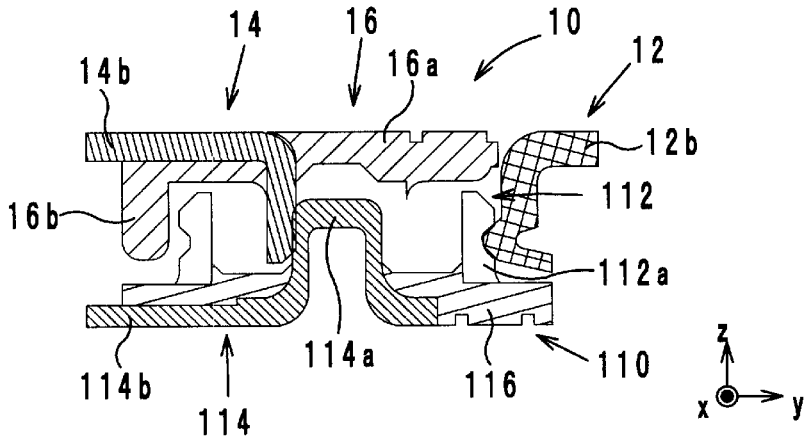
FIG. 11 is a diagram illustrating the sectional structures of the coaxial connector plug 10 and the coaxial connector receptacle 110 after the coaxial connector receptacle 110 has been mounted on the coaxial connector plug 10.

Mounting of the coaxial connector receptacle 110 onto the coaxial connector plug 10 will be described below with reference to FIG. 10 and FIG. 11. FIG. 10 is a diagram illustrating the sectional structures of the coaxial connector plug 10 and the coaxial connector receptacle 110 before the coaxial connector receptacle 110 is mounted on the coaxial connector plug 10. FIG. 11 is a diagram illustrating the sectional structures of the coaxial connector plug 10 and the coaxial connector receptacle 110 after the coaxial connector receptacle 110 has been mounted on the coaxial connector plug 10.

As illustrated in FIG. 10, the coaxial connector plug 10 is used in a state where an opening of the outer conductor 12*a* is oriented toward the negative side in the z-axis direction. As illustrated in FIG. 11, the coaxial connector receptacle 110 is to be mounted on the coaxial connector plug 10 from the negative side in the z-axis direction. More specifically, the outer conductor 112*a* is to be inserted into the outer conductor 12*a* from the negative side in the z-axis direction. The diameter of the outer peripheral surface of the outer conductor 112*a* is set to be slightly larger than the diameter of the inner peripheral surface of the outer conductor 12*a*. Thus, the outer peripheral surface of the outer conductor 112*a* is pressed into contact with the inner peripheral surface of the outer conductor 12*a*, and the outer conductor 12*a* is pressed and made to expand in the horizontal direction by the outer conductor 112*a*. In other words, the outer conductor 12*a* expands in such a manner that the width of the entire cutting portion S increases. Then, projections and depressions of the inner peripheral surface of the outer conductor 12*a* and projections and depressions of the outer peripheral surface of the outer conductor 112*a* engage with one another. As a result, the outer conductor 12*a* holds the outer conductor 112*a*. The outer conductors 12*a* and 112*a* are maintained at ground potential during use.

In addition, the central conductor 14*a* is to be connected to the central conductor 114*a*. More specifically, as illustrated in FIG. 11, the central conductor 114*a* is to be inserted into the central conductor 14*a*, which has a substantially cylindrical-like shape. The diameter of the outer peripheral surface of the central conductor 114*a* is set to be slightly larger than the diameter of the inner peripheral surface of the central conductor 14*a*. Thus, the outer peripheral surface of the central conductor 114*a* is pressed into contact with the inner peripheral surface of the central conductor 14*a*, and the central conductor 14*a* is pressed and made to extend toward outside in the horizontal direction by the central conductor 114*a*. As a result, the central conductor 14*a* holds the central conductor 114*a*. A high-frequency signal current flows through the central conductors 14*a* and 114*a* during use.

Advantageous Effect

According to the coaxial connector plug 10 according to the present embodiment, the probability of the coaxial connector plug 10 easily separating from the coaxial connector receptacle 110 can be reduced. More specifically, in the coaxial connector plug 510 described in Japanese Unexamined Patent Application Publication No. 2013-118121, in the case of trying to reduce the height of the coaxial connector plug 510, the height of the outer conductor 512*a* in the top-bottom direction decreases. However, in the case where the height of the outer conductor 512*a* in the top-bottom direction decreases, the rigidity of the outer conductor 512*a* decreases. Accordingly, the outer conductor 512*a* cannot be pressed into contact with the outer peripheral surface of the outer conductor of the coaxial connector receptacle with sufficient strength. As a result, the coaxial connector plug 510 easily separates from the coaxial connector receptacle.

Here, in the coaxial connector plug 10, each of the outer terminals 12*e* and 12*f* is fixed to a land of a circuit board with solder or the like. Therefore, at the time of mounting the coaxial connector receptacle 110, elastic deformation occurs in portions of the outer conductor 12*a* between the outer terminals 12*e* and 12*f* and the cutting portion S. Accordingly, in the coaxial connector plug 10, as illustrated in FIG. 1 to FIG. 3, the outer terminals 12*e* and 12*f* are disposed further toward the side on which the cutting portion S is formed than the straight line L2 with the cutting portion S interposed therebetween when viewed in plan in the z-axis direction. Thus, the lengths of the portions of the outer conductor 12*a* between the outer terminals 12*e* and 12*f* and the cutting portion S are decreased. Therefore, it is not likely that elastic deformation will occur in the portions of the outer conductor 12*a* between the outer terminals 12*e* and 12*f* and the cutting portion S. As a result, the outer conductor 12*a* is strongly pressed into contact with the outer conductor 112*a*, and the probability of the coaxial connector plug 10 easily separating from the coaxial connector receptacle 110 can be reduced.

In addition, a reduction in the size of the coaxial connector plug 10 can be facilitated. More specifically, in the coaxial connector plug 10, as illustrated in FIG. 1 to FIG. 3, the outer terminals 12*e* and 12*f* are disposed further toward the side on which the cutting portion S is formed than the straight line L2 with the cutting portion S interposed therebetween when viewed in plan in the z-axis direction. Thus, as illustrated in FIG. 3, when viewed in plan in the y-axis direction, the outer terminals 12*c* and 12*d* do not project out from the outer conductor 12*a*. Therefore, the width of the coaxial connector plug 10 in the x-axis direction can be reduced. Since the outer terminal 14*b* extends toward the negative side in the y-axis direction, the outer terminal 14*b* does not project out from the outer conductor 12*a* when viewed in plan in the y-axis direction. Therefore, also from this standpoint, the width of the coaxial connector plug 10 in the x-axis direction can be reduced.

The coaxial connector plug 10 is fixed to a circuit board by the outer terminals 12*b* to 12*f*. Since the outer terminals 12*b* to 12*f* are connected to the outer conductor 12*a*, the outer conductor 12*a* is fixed in place at five points. On the other hand, in the coaxial connector plug 510, the outer conductor 512*a* is fixed in place at three points. Therefore, the outer conductor 12*a* of the coaxial connector plug 10 is more resistant to elastic deformation than the outer conductor 512*a* of the coaxial connector plug 510. Therefore, the probability of the coaxial connector plug 10 easily separating from the coaxial connector receptacle 110 can be reduced.

First Modification

Figure 12:
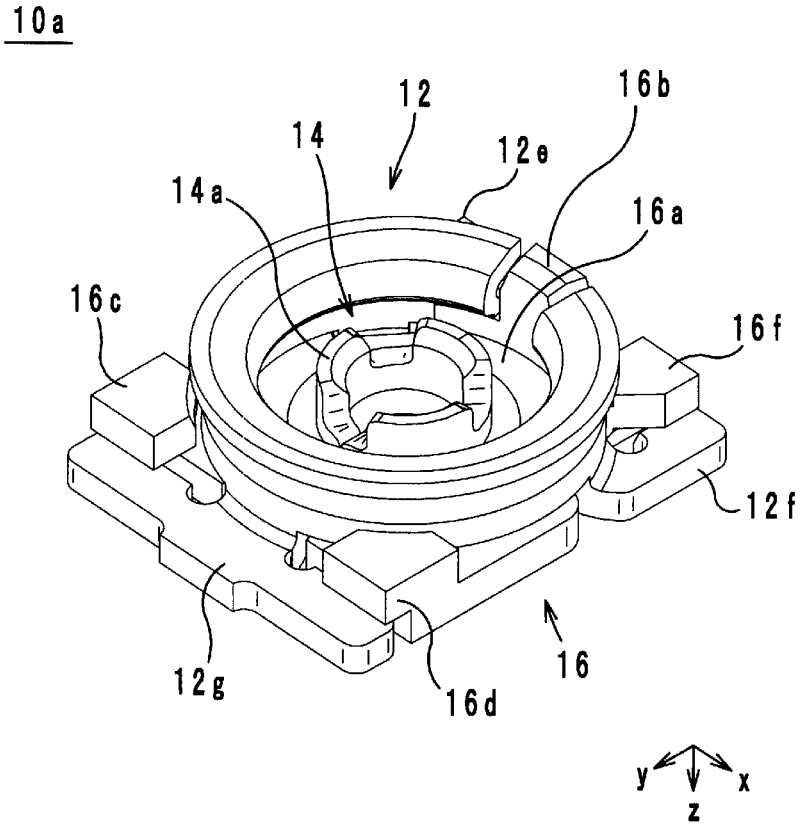
FIG. 12 is an external perspective view of a coaxial connector plug 10*a* according to a first modification.
Figure 13:
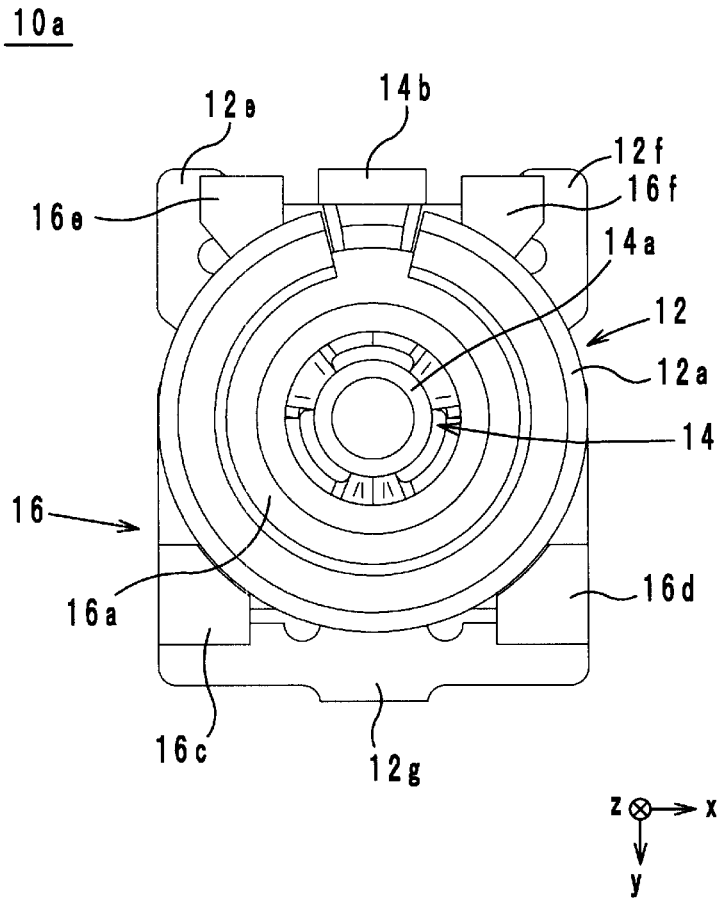
FIG. 13 is a diagram illustrating the coaxial connector plug 10*a* according to the first modification when viewed in plan in the z-axis direction.

A coaxial connector plug 10*a* according to a first modification will be described below with reference to FIG. 12 and FIG. 13. FIG. 12 is an external perspective view of the coaxial connector plug 10*a* according to the first modification. FIG. 13 is a diagram illustrating the coaxial connector plug 10*a* according to the first modification when viewed in plan in the z-axis direction.

A difference from the coaxial connector plug 10 is that, in the coaxial connector plug 10*a*, the outer conductive unit 12 includes an outer terminal 12*g* instead of the outer terminals 12*c* and 12*d*. This difference will be mainly described below in the following description of the coaxial connector plug 10*a*.

The outer terminal 12*g* has a substantially T-like shape when viewed in plan in the z-axis direction. The outer terminal 12*g* is drawn out from the outer conductor 12*a* toward the negative side in the z-axis direction and bent toward the positive side in the y-axis direction.

Similarly to the coaxial connector plug 10, also in the coaxial connector plug 10*a*, which has the above-described configuration, the probability of the coaxial connector plug 10*a* easily separating from the coaxial connector receptacle 110 can be reduced.

Second Modification

Figure 14:
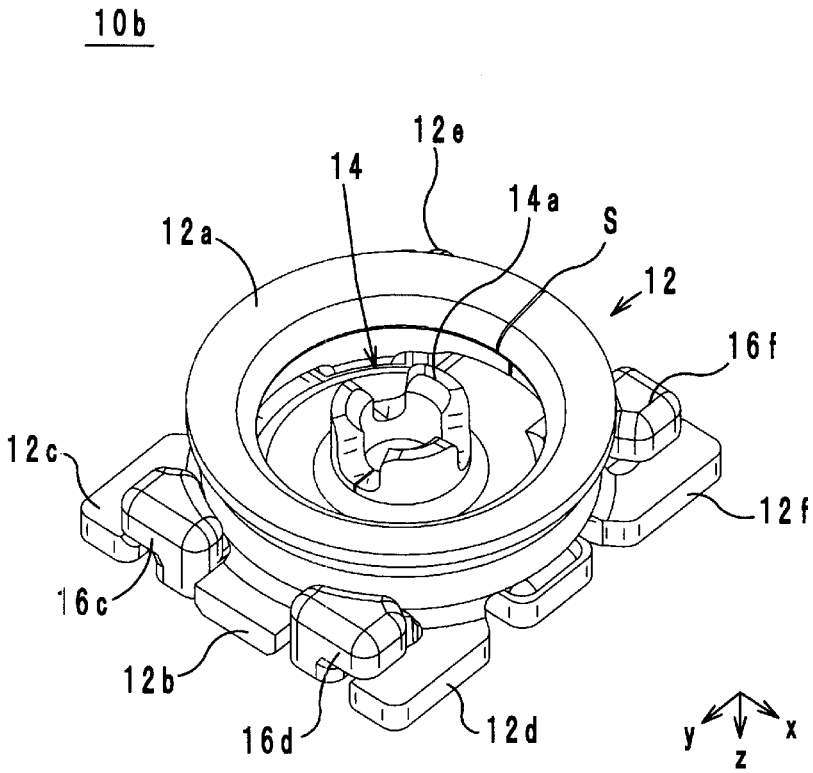
FIG. 14 is an external perspective view of a coaxial connector plug 10*b* according to a second modification.
Figure 15:
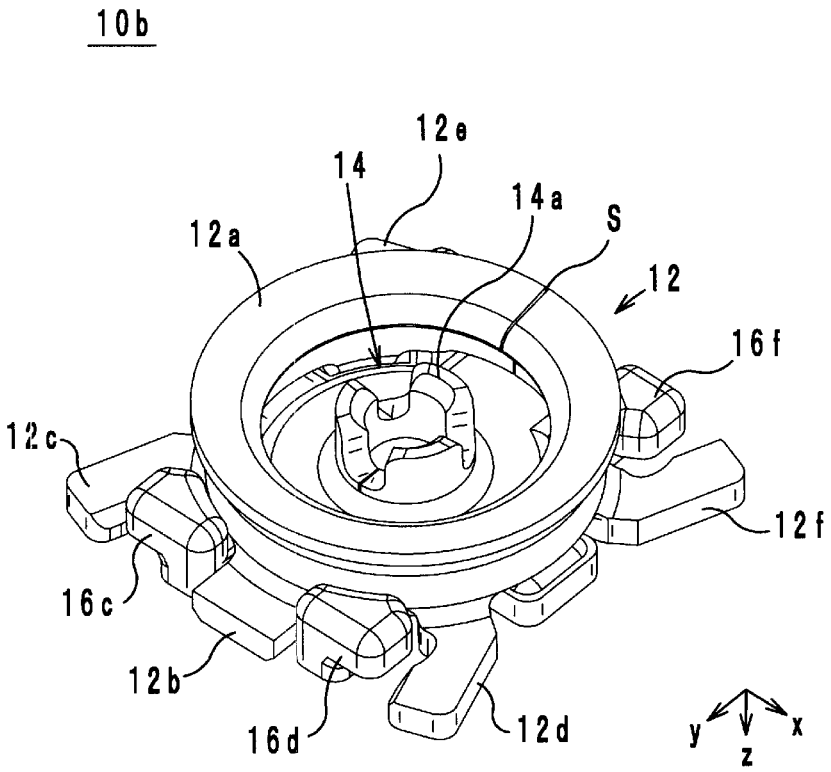
FIG. 15 is an external perspective view of the coaxial connector plug 10*b* according to the second modification during a process of manufacturing the coaxial connector plug.
Figure 16:
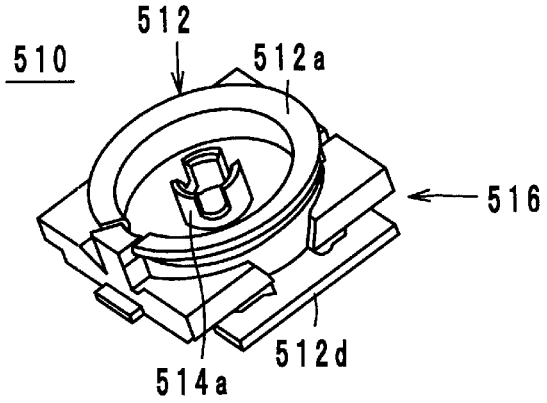
FIG. 16 PRIOR ART
FIG. 16 is an external perspective view of the coaxial connector plug 510 described in Japanese Unexamined Patent Application Publication No. 2013-118121.

A coaxial connector plug 10*b* according to a second modification will be described below with reference to FIG. 14 and FIG. 15. FIG. 14 is an external perspective view of the coaxial connector plug 10*b* according to the second modification. FIG. 15 is an external perspective view of the coaxial connector plug 10*b* according to the second modification during a process of manufacturing the coaxial connector plug 10*b*.

A difference between the coaxial connector plug 10*b* and the coaxial connector plug 10 is that, as illustrated in FIG. 14, there is no gap in the cutting portion S. As described above, there is no gap in the cutting portion S, so that occurrence of variations in the inner diameter of the outer conductor 12*a* can be suppressed.

More specifically, when the outer conductive unit 12 is mounted onto the insulator 16, as illustrated in FIG. 15, the outer terminals 12*c* to 12*f* each of which is in an open state are caused to slide underneath the engagement portions 16*c* to 16*f* on the positive side in the z-axis direction, respectively, by applying pressure to the outer terminals 12*c* to 12*f* from both sides in the x-axis direction. In this case, the pressing force is also applied to the outer conductor 12*a*. However, since there is no gap in the cutting portion S in the coaxial connector plug

10*b*, even if deformation occurs in the outer conductor 12*a*, the size of a gap in the cutting portion S will not change. Therefore, in the coaxial connector plug 10*b*, occurrence of variations in the inner diameter of the outer conductor 12*a* can be suppressed.

In addition, in the coaxial connector plug 10*b*, the deformation that occurs in the outer conductor 12*a* when the outer conductive unit 12 is mounted on the insulator 16 is smaller compared with that in the coaxial connector plug 10. Therefore, the pressing force, which has been applied to the outer terminals 12*c* to 12*f*, is not used for the deformation of the outer conductor 12*a* but used for the deformation of each of the outer terminals 12*c* to 12*f*. As a result, deformation occurs in the outer terminals 12*c* to 12*f* with more certainty.

Other Embodiments

The coaxial connector plug according to the present disclosure is not limited to the coaxial connector plugs 10, 10*a*, and 10*b*, and modifications may be made within the scope of the present disclosure.

As described above, the present disclosure is useful in a coaxial connector plug, and in particular, the present disclosure has an advantage of reducing the probability of a coaxial connector plug easily separating from a coaxial connector receptacle.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coaxial connector plug comprising:

a first outer conductive unit including:

a first outer conductor having a substantially ring-like shape in a portion of which a cutting portion is formed, when viewed in plan from above, along a first line that extends through a center of the first outer conductor, and a first outer terminal and a second outer terminal drawn out downwardly from the first outer conductor; and a first central conductive unit including a first central conductor disposed in an area surrounded by the first outer conductor when viewed in plan from above, wherein, when viewed in plan from above, the cutting portion is interposed between the first outer terminal and the second outer terminal, wherein the first outer terminal and the second outer terminal each includes a front edge that curves towards the first line, and wherein the first outer terminal and the second outer terminal are entirely disposed, when viewed in plan from above, further toward a side on which the cutting portion is formed than a second line that is perpendicular to the first line and extends through the center of the first outer conductor.

2. The coaxial connector plug according to claim 1, wherein the first outer terminal and the second outer terminal project out from the first outer conductor in a direction different from a direction in which the second line extends when viewed in plan, in a direction in which the first line extends.

3. The coaxial connector plug according to claim 1, wherein when viewed in plan from above, the first outer terminal extends in a direction from the center of the first outer conductor toward a portion in which the first outer terminal and the first outer conductor are connected to each other and is bent to extend in a direction that is parallel to the first line, and wherein when viewed in plan from above, the second outer terminal extends in a direction from the center of the first outer conductor toward a portion in which the second outer terminal and the first outer conductor are connected to each other and is bent to extend in a direction that is parallel to the first line.

4. The coaxial connector plug according to claim 1, wherein the first outer conductive unit includes a third outer terminal that extends in a direction opposite to a direction from the center of the first outer conductor toward the cutting portion when viewed in plan from above.

5. The coaxial connector plug according to claim 1, further comprising:

a fourth outer terminal drawn out downwardly from the first outer conductor and disposed further toward a side opposite to the side on which the cutting portion is formed than the second line when viewed in plan from above; and a fifth outer terminal drawn out downwardly from the first outer conductor and disposed further toward the side opposite to the side on which the cutting portion is formed than the second line when viewed in plan from above.

6. The coaxial connector plug according to claim 1, wherein the cutting portion is discontinuous.

7. The coaxial connector plug according to claim 1, wherein a substantially cylindrical second outer conductor of a coaxial connector receptacle is inserted into the first outer conductor, and wherein a second central conductor of the coaxial connector receptacle is connected to the first central conductor.

* * * * *